US008247042B2

(12) United States Patent
Asakawa et al.

(10) Patent No.: US 8,247,042 B2
(45) Date of Patent: Aug. 21, 2012

(54) RECORDING MEDIUM

(75) Inventors: Hiroshi Asakawa, Ebina (JP); Masaya Asao, Yokohama (JP); Hitoshi Nagashima, Kawasaki (JP); Takatoshi Tanaka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/110,521

(22) Filed: May 18, 2011

(65) Prior Publication Data

US 2011/0300315 A1 Dec. 8, 2011

(30) Foreign Application Priority Data

Jun. 4, 2010 (JP) ..... 2010-129273

(51) Int. Cl.
*B41M 5/40* (2006.01)

(52) U.S. Cl. ..... 428/32.18; 428/32.2

(58) Field of Classification Search ..... 428/32.18, 428/32.2
See application file for complete search history.

(56) References Cited

U.S. PATENT DOCUMENTS

| | | | | |
|---|---|---|---|---|
| 6,848,781 | B2 | 2/2005 | Ogino et al. | |
| 7,291,361 | B2 | 11/2007 | Ogino et al. | |
| 7,662,452 | B2 | 2/2010 | Nagashima et al. | |
| 7,846,516 | B2 | 12/2010 | Kamo et al. | |
| 7,867,586 | B2 | 1/2011 | Kamo et al. | |
| 2002/0025413 | A1* | 2/2002 | Ohbayashi et al. | 428/195 |
| 2002/0196322 | A1* | 12/2002 | Fujii et al. | 347/105 |
| 2003/0167950 | A1* | 9/2003 | Mori | 101/453 |
| 2004/0131892 | A1* | 7/2004 | Sueki et al. | 428/694 T |
| 2005/0196558 | A1 | 9/2005 | Suzuki et al. | |
| 2010/0098866 | A1 | 4/2010 | Nagashima et al. | |
| 2010/0183828 | A1 | 7/2010 | Asao et al. | |
| 2010/0310795 | A1 | 12/2010 | Tanaka et al. | |
| 2011/0059298 | A1 | 3/2011 | Nagashima et al. | |

FOREIGN PATENT DOCUMENTS

| | | | |
|---|---|---|---|
| EP | 1 571 001 | A2 | 9/2005 |
| JP | 2000-296667 | A | 10/2000 |
| JP | 2005-246836 | A | 9/2005 |

OTHER PUBLICATIONS

Aug. 5, 2011 European Search Report in European Patent Appln. No. 11004323.9.
Quick Guide to Precision Measuring Instruments, Surftest (Surface Roughness Testers), pp. 38-39 [retrieved on Mar. 8, 2012]. Retrieved from the Internet: <URL: http://www.mitutoyo.co.jp/eng/products/menu/QuickGuide_Surftest.pdf>.
Softgauge Basic Framework, Specification of Parameters, Chapter 3 [retrieved on Mar. 8, 2012]. Retrieved from the Internet: <URL: http://161.112.232.32/softgauges/pdf/Specification.pdf>.
Tanaka, et al., U.S. Appl. No. 13/023,803, filed Feb. 9, 2011.
Asao, et al., U.S. Appl. No. 13/111,213, filed May 19, 2011.
Tanaka, et al., U.S. Appl. No. 13/112,175, filed May 20, 2011.

* cited by examiner

*Primary Examiner* — Betelhem Shewareged
(74) *Attorney, Agent, or Firm* — Fitzpatrick, Cella, Harper & Scinto

(57) ABSTRACT

The invention provides a recording medium capable of inhibiting cracks and also inhibiting peeling off of an ink receiving layer upon folding of the recording medium. The recording medium has a substrate and an ink receiving layer provided on the substrate, wherein the substrate is a resin-coated substrate obtained by coating a base material with a resin, the arithmetic average roughness Ra of a surface of the substrate on the side of the ink receiving layer as prescribed by JIS B 0601:2001 is 3.0 μm or more, the skewness Rsk of a roughness curve of the surface of the substrate as prescribed by JIS B 0601:2001 is 0.2 or less, and the coating thickness of the ink receiving layer is 50 μm or less.

8 Claims, No Drawings

RECORDING MEDIUM

BACKGROUND OF THE INVENTION

1. Field of the Invention

The present invention relates to a recording medium.

2. Description of the Related Art

A recording medium having an ink receiving layer provided on a resin-coated substrate obtained by coating a base material with a resin is known as a recording medium for conducting recording by an ink jet recording method or with a felt-tip pen. When such a recording medium is folded, the ink receiving layer may be peeled off in some cases. However, by providing uneven profiles on the surface of the substrate, adhesion between the substrate and the ink receiving layer can be strengthened to inhibit the peeling off of the ink receiving layer.

As a recording medium having uneven profiles on the surface of a substrate, Japanese Patent Application Laid-Open No. 2005-246836 describes a recording medium regularly having five to ten dented and protruded forms in a distance of 3 mm on the surface of a resin-coated substrate, a center line average roughness of 2.5 μm or more, and a 10-point average roughness that is 4 times to times as much as the center line average roughness. Japanese Patent Application Laid-Open No. 2000-296667 describes a recording medium having a 60-degree specular glossiness on the surface of 7% to 50% and having an ink receiving layer on a substrate having a center line average roughness of 1.0 μm to 5.0 μm. According to Japanese Patent Application Laid-Open No. 2005-246836 and Japanese Patent Application Laid-Open No. 2000-296667, it is described that cracks of the ink receiving layer can also be inhibited.

SUMMARY OF THE INVENTION

An investigation by the present inventors has revealed that cracks may occur in the ink receiving layer in some cases even when the center line surface roughness Ra on the surface of the substrate is made great. When the coating thickness of the ink receiving layer is great in particular, the ink receiving layer has tended to easily cause cracks when the ink receiving layer is applied on the substrate and dried.

Accordingly, it is an object of the present invention to provide a recording medium capable of inhibiting cracks and also inhibiting peeling off of an ink receiving layer upon folding of the recording medium.

In order to achieve the above object, the present invention provides a recording medium comprising a substrate and an ink receiving layer provided on the substrate, wherein the substrate is a resin-coated substrate obtained by coating a base material with a resin, the arithmetic average roughness Ra of a surface of the substrate on the side of the ink receiving layer as prescribed by JIS B 0601:2001 is 3.0 μm or more, the skewness Rsk of a roughness curve of the surface of the substrate as prescribed by JIS B 0601:2001 is 0.2 or less, and the coating thickness of the ink receiving layer is 50 μm or less.

According to the present invention, there can be provided a recording medium capable of inhibiting cracks and also inhibiting peeling off of an ink receiving layer upon folding of the recording medium.

Further features of the present invention will become apparent from the following description of exemplary embodiments.

DESCRIPTION OF THE EMBODIMENTS

Preferred embodiments of the present invention will now be described in detail. Incidentally, the present invention is not interpreted as being limited to these descriptions.

Recording Medium

The recording medium according to the present invention is a recording medium having a resin-coated substrate obtained by coating a base material with a resin and an ink receiving layer provided on the substrate. The ink receiving layer may be provided on one surface or both surfaces of the substrate. Another layer may be provided on a surface of the ink receiving layer (on the side opposite to the substrate) so far as the ink absorbency of the ink receiving layer is not greatly impaired. Alternatively, a further layer may be provided between the ink receiving layer and the substrate so far as cracks do not occur in the ink receiving layer.

Peeling off of the ink receiving layer caused by folding the recording medium is considered to be attributable to the condition that adhesion between the substrate and the ink receiving layer is smaller than stress generated by folding of the recording medium. In the recording medium according to the present invention, the arithmetic average roughness Ra of a surface of the substrate on the side of the ink receiving layer as prescribed by JIS B 0601:2001 is 3.0 μm or more. When the ink receiving layer is provided on both surfaces of the substrate, the Ra of each surface of the substrate is 3.0 μm or more. Since the Ra is 3.0 μm or more, adhesion between the substrate and the ink receiving layer becomes great, and peeling off of the ink receiving layer upon folding of the recording medium can be satisfactorily inhibited. The Ra is favorably 4.0 μm or more, more favorably 5.0 μm.

On the other hand, when an ink receiving layer coating liquid is applied on to a substrate to form an ink receiving layer, the profile on the surface of the ink receiving layer is liable to be affected by the profile of the surface of the substrate. Therefore, the arithmetic average roughness Ra of the surface of the substrate on the side of the ink receiving layer as prescribed by JIS B 0601:2001 is favorably 7.0 μm or less from the viewpoint of glossiness of the surface of the ink receiving layer.

Here, an investigation by the present inventors has revealed that when the arithmetic average roughness Ra of the surface of the substrate is simply made great for inhibiting peeling off of the ink receiving layer upon folding of the recording medium, cracks may occur in the ink receiving layer in some cases when the coating thickness of the ink receiving layer is great in particular. As a result of having studied the cracks, it has been found that there is a relation between the occurrence of cracks and the skewness Rsk of a roughness curve of the surface of the substrate as prescribed by JIS B 0601:2001. The Rsk expresses a characteristic in a height direction of surface roughness. When a dented portion is larger than a protruded portion, the Rsk indicates a positive value, while the Rsk indicates a negative value when the dented portion is smaller than the protruded portion.

In the recording medium according to the present invention, the skewness Rsk of a roughness curve of a surface of the substrate on the side of the ink receiving layer as prescribed by JIS B 0601:2001 is 0.2 or less. When the ink receiving layer is provided on both surfaces of the substrate, the Rsk of each surface of the substrate is 0.2 or less. The ink receiving layer is formed by coating the substrate with an ink receiving layer coating liquid containing a pigment and a binder and drying the coating liquid. When the surface of the substrate has a certain roughness, the coating liquid tends to be applied to dented portions of the substrate in a large amount compared with protruded portions thereof. As a result, the ink receiving layer formed tends to become thick on the dented portions compared with on the protruded portions. The area of the dented portions becomes large when the Rsk of the surface of the substrate on the side of the ink receiving layer is more than 0.2, so that coating liquid is liable to be collected on the dented portions. Therefore, thickness unevenness of the ink receiving layer between the protruded portions and the dented portions becomes marked to cause cracks due to stress generated upon drying of the coating liquid after the coating. This stress easily occurs when a large amount of thick portions of the ink receiving layer are present. In the present invention, the Rsk of the surface of the substrate on the side of the ink receiving layer is controlled to 0.2 or less for inhibiting this stress. The Rsk is more favorably controlled to 0.0 or less. When the Rsk is 0.0 or less, the width of the protruded portions becomes equal to the width of the dented portions, or the width of the dented portions becomes narrower than the width of the protruded portions, so that the thick portions of the ink receiving layer decrease. Thus, the stress generated upon the drying is relieved and the occurrence of cracks can be more inhibited. The Rsk is favorably −1.5 or more from the viewpoint of the formation of an uneven surface.

The average length RSm of a roughness curve element of the surface of the substrate on the side of the ink receiving layer as prescribed by JIS B 0601:2001 is favorably 0.6 mm or less from the viewpoint of making the dented portions narrow. The RSm expresses a characteristic in a lateral direction (horizontal direction) of surface roughness and is a value indicating a space between dented and protruded portions. The RSm is controlled to 0.6 mm or less, whereby the volume of the dented portions in the surface of the substrate can be made smaller though it depends on the characteristic sin the vertical direction (height direction). As a result, the stress generated upon the drying is relieved, and the occurrence of cracks can be more inhibited. The RSm is favorably 0.1 mm or more from the viewpoint of the formation of an uneven surface.

As a method for controlling the Ra, Rsk and RSm of the surface of the substrate within the above respective ranges, a method of subjecting the surface of a substrate obtained by coating a base material with a resin to an embossing treatment is favorable. For example, a representative method for subjecting the surface of the polyolefin resin to the embossing treatment is a method of coating a base material by extruding a molten polyolefin resin and then bring the coated surface into contact under pressure with an embossing roller to apply a pattern of fine unevenness to the surface of the polyolefin resin. There are, for example, the following 2 favorable methods as methods for conducting patterning. One method is a method of subjecting resin-coated paper obtained by melt extrusion to an embossing calender treatment at a temperature close to room temperature. The other method is a method of forming unevenness while cooling by means of a cooling roll with the surface of the roll engraved with a pattern upon extrusion coating of the polyolefin resin. In particular, the latter method is favorable because the embossing can be conducted under a relatively low pressure, and exacter and evener embossing can be conducted.

In order to develop good ink absorbency, the coating thickness of the ink receiving layer is favorably 15 μm or more, more favorably 25 μm or more, still more favorably 40 μm or more. Since the surface roughness of the substrate in the recording medium according to the present invention is controlled as described above, the occurrence of cracks can be inhibited even when the coating thickness of the ink receiving layer is thick.

However, when the ink receiving layer is too thick, cracks may occur in the ink receiving layer in some cases. Thus, the coating thickness of the ink receiving layer is 50 μm or less. Incidentally, the coating thickness in the present invention is a thickness measured upon absolute drying. In the present invention, the recording medium is formed into a square, the thickness upon absolute drying of a portion 1 cm away toward the direction of the center of gravity of the quadrangle from each corner is measured by means of a scanning electron microscope, and the average value of the measured values is regarded as the coating thickness.

Substrate

The substrate of the present invention is a resin-coated substrate obtained by coating a base material with a resin.

As the base material, is mentioned a paper base material. The paper base material is obtained by using wood pulp as a main material and using synthetic pulp such as polypropylene or synthetic fiber such as nylon or polyester in addition to the wood pulp, as needed, to make paper. Examples of the wood pulp include LBKP, LBSP, NBKP, NBSP, LDP, NDP, LUKP and NUKP. Among these, LBKP, NBSP, LBSP, NDP and/or LDP, which are high in short fiber content, are favorably used more than the others. However, the proportion of LBSP and/or LDP in the pulp is favorably 10% by mass or more and 70% by mass or less. The pulp is favorably chemical pulp (sulfate pulp or sulfite pulp) that contains a small amount of purities. Pulp subjected to a bleaching treatment to improve brightness is also favorable. A sizing agent such as a higher fatty acid or alkyl ketene dimer, a white pigment such as calcium carbonate, talc or titanium oxide, a paper-strengthening agent such as starch, polyacrylamide or polyvinyl alcohol, a fluorescent whitening agent, a water-retaining agent such as polyethylene glycol, a dispersant, and a softening agent such as quaternary ammonium may be suitably added into the paper base material. The basis weight of the paper base material is favorably 50 g or more and 250 g or less, particularly favorably 70 g or more and 200 g or less. The thickness of the paper base material is favorably 50 μm or more and 210 μm or less. The paper base material may be subjected to a calendering treatment during a paper making stage or after paper making to give high smoothness thereto. The density of the paper base material is favorably 0.7 g/m$^2$ or more and 1.2 g/m$^2$ or less (JIS P 8118). The stiffness of the paper base material is favorably 20 g or more and 200 g or less under the conditions prescribed by JIS P 8143. The surface of the paper base material may be coated with a surface sizing agent. The pH of the paper base material is favorably 5 or more and 9 or less in terms of a value measured by the hot water extraction method prescribed by JIS P 8113.

The resin for coating the base material is favorably a polyolefin resin. As the polyolefin resin, is favorable polyethylene, polypropylene, polyisobutylene or a copolymer mainly formed of ethylene and propylene. Among these, polyethylene is favorable. As the polyethylene, is mainly favorably used low density polyethylene (LDPE) and/or high density polyethylene (HDPE). Linear low density polyethylene (LLDPE) or polypropylene may also be used. The polyolefin resin is favorably improved in opacity and brightness by adding rutile- or anatase-type titanium oxide into the polyolefin resin. The content of the titanium oxide is favorably 3% by mass or more and 20% by mass or less based on the polyolefin. The coating thickness of the resin is favorably 10 μm or more and 40 μm or less. The coating resin may contain a pigment high in heat resistance and/or a fluorescent whitening agent for adjusting a white ground (blank). Examples of the pigment include ultramarine blue, Berlin blue, cobalt blue, phthalocyanine blue, manganese blue, cerulian blue, tungsten blue, molybdenum blue and anthraquinone blue. Examples of the fluorescent whitening agent include dialkylaminocoumalins, bisdimethylaminostilbene, bismethylaminostilbene, 4-alkoxy-1,8-naphthalenedicarboxylic acid-N-alkylimides, bisbenz-oxazolylethylene and dialkylstilbenes.

Ink Receiving Layer

The ink receiving layer of the present invention is favorably formed with an inorganic pigment and a binder. The ink receiving layer may additionally contain a crosslinking agent, a pH adjustor and various additives. These components will now be described in detail.

As the inorganic pigment, is favorable a white pigment such as precipitated calcium carbonate, magnesium carbonate, kaolin, barium sulfate, aluminum silicate, magnesium silicate, synthetic amorphous silica, colloidal silica, wet or dry silica sol, or alumina hydrate. These inorganic pigments may be used either singly or in any combination thereof. Among these, silica or alumina hydrate is favorable from the viewpoint of ink absorbency. Alumina hydrate is more favorable from the viewpoint of inhibiting the occurrence of undertrapping. On the other hand, gas phase process silica is favorable from the viewpoint of lowering of the visibility of scratches on the surface of the resulting recording medium.

Favorable examples of the binder used include polyvinyl alcohol (PVA), oxidized starch, etherified starch, phosphoric acid esterified starch, carboxymethyl cellulose, hydroxyethyl cellulose, casein, gelatin, soybean protein, polyvinyl pyrrolidone, maleic anhydride resins, latexes of conjugated polymers such as styrene-butadiene copolymers and methyl methacrylate-butadiene copolymers, latexes of acrylic polymers such as acrylic ester and methacrylic ester polymers, latexes of vinyl polymers such as ethylene-vinyl acetate copolymers, melamine resins, urea resins, polymer or copolymer resins of acrylic esters and methacrylic esters, such as polymethyl methacrylate, polyurethane resins, unsaturated polyester resins, vinyl chloride-vinyl acetate copolymers, polyvinyl butyral, and alkyd resins. The above-described binders may be used either singly or in any combination thereof. Among these, PVA is the most favorably used binder. Examples of the PVA include PVA obtained by hydrolyzing polyvinyl acetate. PVA having a viscosity-average polymerization degree of 1,500 or more and 5,000 or less is favorable. The saponification degree thereof is favorably 70 or more and 100 or less. Besides the above, modified PVA such as PVA cationically modified at the terminal thereof or anionically modified PVA having an anionic group may also be used. When alumina hydrate is used as the inorganic pigment, the amount of the binder in the ink receiving layer is favorably 5% by mass or more and 15% by mass or less, more favorably 7% by mass or more and 15% by mass or less, still more favorably 8% by mass or more and 15% by mass or less based on the total mass of the inorganic pigment in the ink receiving layer. When silica is used as the inorganic pigment, the amount of the binder in the ink receiving layer is favorably 20% by mass or more and 30% by mass or less based on the total mass of the inorganic pigment in the ink receiving layer.

No particular limitation is imposed on the crosslinking agent so far as the effect of the present invention is not impaired. However, when PVA is used as a binder, the crosslinking agent is favorably that capable of causing a crosslinking reaction with PVA to cause curing. In particular, boric acid is favorable as the crosslinking agent. Examples of usable boric acid include metaboric acid and hypoboric acid in addition to orthoboric acid ($H_3BO_3$). However, orthoboric acid is favorably used from the viewpoints of the long-term stability of the resulting coating liquid and inhibition of the occurrence of cracks.

The amount of the boric acid used is favorably within a range of 0.2 equivalents or more and 1.2 equivalents or less based on the PVA in the ink receiving layer. With respect to the term "equivalent", the amount of a crosslinking agent theoretically completely reacting with the hydroxyl group of the PVA is regarded as 1.0 equivalent. The amount of a crosslinking agent is controlled within the above range, whereby the long-term stability of the ink receiving layer coating liquid can be particularly improved. In general, the coating liquid comes to be used over a long period of time upon the formation of the ink receiving layer. The content of the boric acid in the coating liquid is controlled within the above range, whereby viscosity increase of the coating liquid and occurrence of gelled products, which are caused during use of the coating liquid for a long period of time, can be excellently inhibited. Therefore, replacement of the coating liquid or cleaning of a coater head may not be frequently conducted, so that lowering of productivity of the recording medium can be inhibited. In addition, when the content of the boric acid in the coating liquid falls within the above range, a uniform and good surface can be obtained.

The ink receiving layer is formed by coating the substrate with an ink receiving layer coating liquid. Any one of, for example, the following acids may be suitably added as a pH adjustor into the ink receiving layer coating liquid. Examples of the acids include formic acid, acetic acid, glycolic acid, oxalic acid, propionic acid, malonic acid, succinic acid, adipic acid, maleic acid, malic acid, tartaric acid, citric acid, benzoic acid, phthalic acid, isophthalic acid, terephthalic acid, glutaric acid, gluconic acid, lactic acid, asparagic acid, glutamic acid, pimelic acid, suberic acid, methanesulfonic acid, and inorganic acids such as hydrochloric acid, nitric acid and phosphoric acid. For example, when alumina hydrate is used as the inorganic pigment, a monobasic acid is favorably used for dispersing the alumina hydrate in water. Therefore, among the above-described pH adjustors, an organic acid such as formic acid, acetic acid, glycolic acid or methanesulfonic acid, or an inorganic acid such as hydrochloric acid or nitric acid is favorably used. As additives, a pigment dispersant and a fastness improver may be suitably added within limits not greatly changing a contact angle of the surface of the ink receiving layer with respect to ion-exchanged water after the formation of the ink receiving layer.

Production Process of Recording Medium

The recording medium according to the present invention is produced according to, for example, the following process. First, an ink receiving layer coating liquid is prepared by mixing an inorganic pigment, binder, crosslinking agent, pH adjustor, various additives and water. The ink receiving layer coating liquid is applied to a substrate and dried to form an ink receiving layer, thereby producing a recording medium according to the present invention. Incidentally, the kinds and amounts of these materials used in the ink receiving layer may be suitably chosen for use so as to satisfy the requirements of the present invention.

The coating method of the ink receiving layer coating liquid will now be described. The coating of the ink receiving layer coating liquid is conducted by on-machine or off-machine coating using any one of, for example, various kinds of curtain coaters, a coater using an extrusion system and a coater using a slide hopper system so as to give a proper coating amount. Upon the coating, the coating liquid may be heated or a coater head may be heated for the purpose of adjusting the viscosity of the coating liquid.

For example, a hot air dryer such as a linear tunnel dryer, arch dryer, air loop dryer or sine curve air float dryer may be used for drying of the coating liquid after coating. An infrared heating dryer or a dryer utilizing microwaves may also be suitably chosen for use.

The present invention will hereinafter be described in detail by the following Examples and Comparative Examples. However, the contents of the present invention are not limited to these examples. Incidentally, "parts" or "part" and "%" are based on the mass unless expressly noted.

Measuring Method of Surface Roughness

Measurements of arithmetic average roughness Ra, skewness Rsk of a roughness curve and average length RSm of a roughness curve element were conducted under the following measuring conditions by means of the following measuring apparatus.

Measuring apparatus: Surfcorder SE3500 (manufactured by Kosaka Laboratory, Ltd.)

Measuring conditions: The measurement was conducted by setting a cutoff value according to JIS B 0601:2001 and conducting evaluation with the length 5 times as much as the cutoff value as an evaluation length.

Preparation of Substrate

Twenty parts of precipitated calcium carbonate was added into a slurry of 100 parts of Laubholz bleached kraft pulp, 2.0 parts of cationized starch and 0.3 parts of an alkenylsuccinic anhydride neutral sizing agent were added, and these components were sufficiently mixed to prepare a paper stock. This paper stock was dried to a water content of 10% by means of a Fourdrinier multi-cylinder paper machine, and a 7% solution of oxidized starch was applied to both sides of the dried product by a size press so as to give a coating amount of 4 $g/m^2$ in total. The thus-coated product was further dried to a water content of 7% to prepare base paper having a basis weight of 110 $g/m^2$. A resin composition composed of 70 parts of low density polyethylene and 20 parts of high density polyethylene was applied to both sides of the base paper by melt extrusion coating so as to give a coating thickness (thickness on one side) shown in Table 1, thereby forming a PE (polyethylene) layer on each side. Just after the application, the polyethylene surfaces were subjected to embossing treatments using cooling rolls having unevennesses of irregular profiles different from one another on their surfaces while cooling. Differences among the embossing treatments were created by adjusting the profiles of dented and protruded portions, and the width and the height between dented and protruded portions to prepare substrates 1 to 17 that are resin-coated substrates. The Ra, Rsk and RSm of each substrate are shown in Table 1. Incidentally, both surfaces of the substrate had the values shown in Table 1.

TABLE 1

| Substrate | Ra (μm) | Rsk | RSm (mm) | Thickness of PE layer (μm) |
|---|---|---|---|---|
| 1 | 3.1 | 0.2 | 0.7 | 25 |
| 2 | 5.2 | 0.2 | 0.7 | 30 |
| 3 | 3.2 | 0.1 | 0.7 | 25 |
| 4 | 5.0 | 0.1 | 0.7 | 30 |
| 5 | 3.3 | 0.0 | 0.7 | 25 |
| 6 | 4.2 | 0.0 | 0.7 | 28 |
| 7 | 5.1 | 0.0 | 0.7 | 30 |
| 8 | 3.1 | −0.1 | 0.7 | 25 |
| 9 | 5.2 | −0.1 | 0.7 | 30 |
| 10 | 3.2 | 0.1 | 0.6 | 25 |
| 11 | 3.1 | 0.0 | 0.6 | 25 |
| 12 | 5.3 | 0.1 | 0.6 | 30 |
| 13 | 5.1 | 0.0 | 0.6 | 30 |
| 14 | 5.1 | 0.2 | 0.5 | 30 |
| 15 | 5.1 | 0.2 | 0.5 | 30 |
| 16 | 2.8 | −0.1 | 0.7 | 25 |
| 17 | 5.1 | 0.3 | 0.7 | 30 |

Preparation of Ink Receiving Layer Coating Liquid A

Alumina hydrate (trade name: Disperal HP14, product of Sasol Co.) was added into ion-exchanged water so as to give a concentration of 30%. Methanesulfonic acid was then added in an amount of 1.5% based on this alumina hydrate, and the resultant mixture was stirred to obtain a colloidal sol. The resultant colloidal sol was diluted with ion-exchanged water in such a manner that the proportion of the alumina hydrate is 27%, thereby obtaining colloidal sol A.

On the other hand, polyvinyl alcohol (trade name: PVA 235, product of Kuraray Co., Ltd.; polymerization degree: 3,500, saponification degree: 88%) was dissolved in ion-exchange water to obtain a 8.0% aqueous solution of polyvinyl alcohol. The resultant polyvinyl alcohol solution was mixed with the colloidal sol A in such a manner that the proportion of polyvinyl alcohol is 7.0% based on the alumina hydrate. A 3.0% aqueous solution of boric acid was then mixed with the resultant mixture in such a manner that the proportion of boric acid is 2.0% based on the alumina hydrate, thereby preparing an ink receiving layer coating Liquid A.

Preparation of Ink Receiving Layer Coating Liquid B

An ink receiving layer coating liquid B was prepared in the same manner as in the preparation of the ink receiving layer coating liquid A except that the above-described aqueous polyvinyl alcohol solution was mixed with the colloidal sol A prepared above in such a manner that the proportion of polyvinyl alcohol is 8.0% based on the alumina hydrate.

Preparation of Ink Receiving Layer Coating Liquid C

An ink receiving layer coating liquid C was prepared in the same manner as in the preparation of the ink receiving layer coating liquid A except that the above-described aqueous polyvinyl alcohol solution was mixed with the colloidal sol A prepared above in such a manner that the proportion of polyvinyl alcohol is 9.0% based on the alumina hydrate.

Preparation of Ink Receiving Layer Coating Liquid D

An ink receiving layer coating liquid D was prepared in the same manner as in the preparation of the ink receiving layer coating liquid A except that the above-described aqueous polyvinyl alcohol solution was mixed with the colloidal sol A prepared above in such a manner that the proportion of polyvinyl alcohol is 10.0% based on the alumina hydrate.

Preparation of Ink Receiving Layer Coating Liquid E

An ink receiving layer coating liquid E was prepared in the same manner as in the preparation of the ink receiving layer coating liquid A except that the above-described aqueous polyvinyl alcohol solution was mixed with the colloidal sol A prepared above in such a manner that the proportion of polyvinyl alcohol is 11.0% based on the alumina hydrate.

Preparation of Ink Receiving Layer Coating Liquid F

An ink receiving layer coating liquid F was prepared in the same manner as in the preparation of the ink receiving layer coating liquid A except that the above-described aqueous polyvinyl alcohol solution was mixed with the colloidal sol A prepared above in such a manner that the proportion of polyvinyl alcohol is 12.0% based on the alumina hydrate.

Preparation of Ink Receiving Layer Coating Liquid G

One hundred parts of silica (trade name: A300, product of Nippon Aerosil Co., Ltd.) and 4 parts of a cationic polymer (trade name: SHALLOL DC902P, product of DAI-ICHI KOGYO SEIYAKU CO., LTD.) were dispersed in ion-exchanged water so as to give a solid content concentration of 18%, and the resultant mixture was dispersed by a high-pressure homogenizer to obtain colloidal sol B.

On the other hand, polyvinyl alcohol (trade name: PVA 235, product of Kuraray Co., Ltd.; polymerization degree: 3,500, saponification degree: 88%) was dissolved in ion-exchange water to obtain a 8.0% aqueous solution of polyvinyl alcohol. The resultant aqueous polyvinyl alcohol solution was mixed with the colloidal sol B in such a manner that the proportion of polyvinyl alcohol is 25.0% based on the silica. A 3.0% aqueous solution of boric acid was then mixed with the resultant mixture in such a manner that the proportion of boric acid is 3.5% based on the silica, thereby preparing an ink receiving layer coating Liquid G.

EXAMPLE 1

The ink receiving layer coating liquid A was applied on to the substrate 1 and dried at 60° C. to prepare a recording medium 1 having an ink receiving layer having a coating thickness of 19 μm.

EXAMPLE 2

The ink receiving layer coating liquid D was applied on to the substrate 1 and dried at 60° C. to prepare a recording medium 2 having an ink receiving layer having a coating thickness of 38 μm.

EXAMPLE 3

The ink receiving layer coating liquid F was applied on to the substrate 1 and dried at 60° C. to prepare a recording medium 3 having an ink receiving layer having a coating thickness of 45 μm.

EXAMPLE 4

The ink receiving layer coating liquid B was applied on to the substrate 2 and dried at 60° C. to prepare a recording medium 4 having an ink receiving layer having a coating thickness of 24 μm.

EXAMPLE 5

The ink receiving layer coating liquid C was applied on to the substrate 2 and dried at 60° C. to prepare a recording medium 5 having an ink receiving layer having a coating thickness of 28 μm.

EXAMPLE 6

The ink receiving layer coating liquid E was applied on to the substrate 2 and dried at 60° C. to prepare a recording medium 6 having an ink receiving layer having a coating thickness of 42 μm.

EXAMPLE 7

The ink receiving layer coating liquid A was applied on to the substrate 3 and dried at 60° C. to prepare a recording medium 7 having an ink receiving layer having a coating thickness of 17 μm.

EXAMPLE 8

The ink receiving layer coating liquid C was applied on to the substrate 3 and dried at 60° C. to prepare a recording medium 8 having an ink receiving layer having a coating thickness of 30 μm.

EXAMPLE 9

The ink receiving layer coating liquid E was applied on to the substrate 3 and dried at 60° C. to prepare a recording medium 9 having an ink receiving layer having a coating thickness of 40 μm.

EXAMPLE 10

The ink receiving layer coating liquid A was applied on to the substrate 4 and dried at 60° C. to prepare a recording medium 10 having an ink receiving layer having a coating thickness of 20 μm.

EXAMPLE 11

The ink receiving layer coating liquid D was applied on to the substrate 4 and dried at 60° C. to prepare a recording medium 11 having an ink receiving layer having a coating thickness of 37 μm.

EXAMPLE 12

The ink receiving layer coating liquid F was applied on to the substrate 4 and dried at 60° C. to prepare a recording medium 12 having an ink receiving layer having a coating thickness of 47 μm.

EXAMPLE 13

The ink receiving layer coating liquid B was applied on to the substrate 5 and dried at 60° C. to prepare a recording medium 13 having an ink receiving layer having a coating thickness of 22 μm.

EXAMPLE 14

The ink receiving layer coating liquid D was applied on to the substrate 5 and dried at 60° C. to prepare a recording medium 14 having an ink receiving layer having a coating thickness of 32 μm.

EXAMPLE 15

The ink receiving layer coating liquid E was applied on to the substrate 5 and dried at 60° C. to prepare a recording medium 15 having an ink receiving layer having a coating thickness of 41 μm.

EXAMPLE 16

The ink receiving layer coating liquid A was applied on to the substrate 6 and dried at 60° C. to prepare a recording medium 16 having an ink receiving layer having a coating thickness of 16 μm.

EXAMPLE 17

The ink receiving layer coating liquid D was applied on to the substrate 6 and dried at 60° C. to prepare a recording medium 17 having an ink receiving layer having a coating thickness of 39 μm.

EXAMPLE 18

The ink receiving layer coating liquid F was applied on to the substrate 6 and dried at 60° C. to prepare a recording medium 18 having an ink receiving layer having a coating thickness of 50 μm.

EXAMPLE 19

The ink receiving layer coating liquid B was applied on to the substrate 7 and dried at 60° C. to prepare a recording medium 19 having an ink receiving layer having a coating thickness of 23 μm.

EXAMPLE 20

The ink receiving layer coating liquid C was applied on to the substrate 7 and dried at 60° C. to prepare a recording medium 20 having an ink receiving layer having a coating thickness of 25 μm.

EXAMPLE 21

The ink receiving layer coating liquid E was applied on to the substrate 7 and dried at 60° C. to prepare a recording medium 21 having an ink receiving layer having a coating thickness of 44 μm.

EXAMPLE 22

The ink receiving layer coating liquid G was applied on to the substrate 7 and dried at 60° C. to prepare a recording medium 22 having an ink receiving layer having a coating thickness of 34 μm.

EXAMPLE 23

The ink receiving layer coating liquid A was applied on to the substrate 8 and dried at 60° C. to prepare a recording medium 23 having an ink receiving layer having a coating thickness of 15 μm.

EXAMPLE 24

The ink receiving layer coating liquid D was applied on to the substrate 8 and dried at 60° C. to prepare a recording medium 24 having an ink receiving layer having a coating thickness of 31 μm.

EXAMPLE 25

The ink receiving layer coating liquid F was applied on to the substrate 8 and dried at 60° C. to prepare a recording medium 25 having an ink receiving layer having a coating thickness of 45 μm.

EXAMPLE 26

The ink receiving layer coating liquid A was applied on to the substrate 9 and dried at 60° C. to prepare a recording medium 26 having an ink receiving layer having a coating thickness of 18 μm.

EXAMPLE 27

The ink receiving layer coating liquid C was applied on to the substrate 9 and dried at 60° C. to prepare a recording medium 27 having an ink receiving layer having a coating thickness of 27 μm.

EXAMPLE 28

The ink receiving layer coating liquid F was applied on to the substrate 9 and dried at 60° C. to prepare a recording medium 28 having an ink receiving layer having a coating thickness of 48 μm.

EXAMPLE 29

The ink receiving layer coating liquid D was applied on to the substrate 10 and dried at 60° C. to prepare a recording medium 29 having an ink receiving layer having a coating thickness of 36 μm.

EXAMPLE 30

The ink receiving layer coating liquid E was applied on to the substrate 11 and dried at 60° C. to prepare a recording medium 30 having an ink receiving layer having a coating thickness of 43 μm.

EXAMPLE 31

The ink receiving layer coating liquid C was applied on to the substrate 12 and dried at 60° C. to prepare a recording medium 31 having an ink receiving layer having a coating thickness of 29 μm.

EXAMPLE 32

The ink receiving layer coating liquid F was applied on to the substrate 13 and dried at 60° C. to prepare a recording medium 32 having an ink receiving layer having a coating thickness of 49 μm.

EXAMPLE 33

The ink receiving layer coating liquid B was applied on to the substrate 14 and dried at 60° C. to prepare a recording medium 33 having an ink receiving layer having a coating thickness of 21 μm.

EXAMPLE 34

The ink receiving layer coating liquid F was applied on to the substrate 15 and dried at 60° C. to prepare a recording medium 34 having an ink receiving layer having a coating thickness of 46 μm.

COMPARATIVE EXAMPLE 1

The ink receiving layer coating liquid D was applied on to the substrate 16 and dried at 60° C. to prepare a recording medium 35 having an ink receiving layer having a coating thickness of 33 μm.

COMPARATIVE EXAMPLE 2

The ink receiving layer coating liquid F was applied on to the substrate 9 and dried at 60° C. to prepare a recording medium 36 having an ink receiving layer having a coating thickness of 52 μm.

COMPARATIVE EXAMPLE 3

The ink receiving layer coating liquid C was applied on to the substrate 17 and dried at 60° C. to prepare a recording medium 37 having an ink receiving layer having a coating thickness of 26 μm.

Evaluations

The recording media prepared above were subjected to the following evaluations.

Cracks

After the formation of each ink receiving layer, the lengths of cracks on the surface of the ink receiving layer were visually evaluated according to the following criteria.

A: Occurrence of cracks was not observed;

B: Occurrence of cracks was observed, but the lengths of the cracks were all less than 1.0 mm;

C: Cracks having a length of 1.0 mm or more were observed.

Peeling Off of Ink Receiving Layer

A black image was printed on the whole surface of each recording medium by the Photo Paper Gloss Gold mode (standard setting, color/density: non-matched) by means of an ink jet recording apparatus (trade name: PIXUS MP990, manufactured by Canon Inc.). The recording medium was then cut into a square of 10 cm×10 cm in size, and a folding operation of folding the cut recording medium at the center thereof in such a manner that the surface having the ink receiving layer becomes inside was performed once. The folding operation was securely performed in such a manner that the surfaces of the recording medium folded overlap each other. The occurrence of peeling off of the ink receiving layer after the folding operation was visually evaluated according to the following criteria.

A: No peeling off of the ink receiving layer was observed;

B: Peeling off of the ink receiving layer was slightly observed;

C: Peeling off of the ink receiving layer was clearly observed.

Ink Absorbency

The following images were recorded on each recording medium by the Photo Paper Gloss Gold mode (standard setting, color/density: non-matched) by means of an ink jet recording apparatus (trade name: PIXUS MP990, manufactured by Canon Inc.).

Images: Black image solid-printed on a region of 5 cm by 5 cm at (R,G,B)=(0,0,0) by the RGB mode of PhotoShop 7.0, and yellow image solid-printed on a region of 5 cm by 5 cm adjoining the black image at (R,G,B)=(255,255,0).

Bleeding is observed at the adjoining portion between images when the ink absorbency is poor. Accordingly, the adjoining portion between the above images was visually observed to evaluate the ink absorbency according to the following criteria.

A: No bleeding was observed between the black image and the yellow image;

B: Bleeding was slightly observed between the black image and the yellow image;

C: Bleeding was clearly observed between the black image and the yellow image.

TABLE 2

| | Recording medium | Substrate | Ra (μm) | Rsk | RSm (mm) | Coating thickness of ink receiving layer (μm) | Cracks | Peeling off | Ink absorbency |
|---|---|---|---|---|---|---|---|---|---|
| Ex. 1 | 1 | 1 | 3.1 | 0.2 | 0.7 | 19 | B | B | B |
| Ex. 2 | 2 | 1 | 3.1 | 0.2 | 0.7 | 38 | B | B | A |
| Ex. 3 | 3 | 1 | 3.1 | 0.2 | 0.7 | 45 | B | B | A |
| Ex. 4 | 4 | 2 | 5.2 | 0.2 | 0.7 | 24 | B | A | B |
| Ex. 5 | 5 | 2 | 5.2 | 0.2 | 0.7 | 28 | B | A | A |
| Ex. 6 | 6 | 2 | 5.2 | 0.2 | 0.7 | 42 | B | A | A |
| Ex. 7 | 7 | 3 | 3.2 | 0.1 | 0.7 | 17 | A | B | B |
| Ex. 8 | 8 | 3 | 3.2 | 0.1 | 0.7 | 30 | B | B | A |
| Ex. 9 | 9 | 3 | 3.2 | 0.1 | 0.7 | 40 | B | B | A |
| Ex. 10 | 10 | 4 | 5.0 | 0.1 | 0.7 | 20 | A | A | B |
| Ex. 11 | 11 | 4 | 5.0 | 0.1 | 0.7 | 37 | B | A | A |
| Ex. 12 | 12 | 4 | 5.0 | 0.1 | 0.7 | 47 | B | A | A |
| Ex. 13 | 13 | 5 | 3.3 | 0.0 | 0.7 | 22 | A | B | B |
| Ex. 14 | 14 | 5 | 3.3 | 0.0 | 0.7 | 32 | A | B | A |
| Ex. 15 | 15 | 5 | 3.3 | 0.0 | 0.7 | 41 | B | B | A |
| Ex. 16 | 16 | 6 | 4.2 | 0.0 | 0.7 | 16 | A | A | B |
| Ex. 17 | 17 | 6 | 4.2 | 0.0 | 0.7 | 39 | A | B | A |
| Ex. 18 | 18 | 6 | 4.2 | 0.0 | 0.7 | 50 | B | B | A |
| Ex. 19 | 19 | 7 | 5.1 | 0.0 | 0.7 | 23 | A | A | B |
| Ex. 20 | 20 | 7 | 5.1 | 0.0 | 0.7 | 25 | A | A | A |
| Ex. 21 | 21 | 7 | 5.1 | 0.0 | 0.7 | 44 | B | A | A |
| Ex. 22 | 22 | 7 | 5.1 | 0.0 | 0.7 | 34 | A | A | A |
| Ex. 23 | 23 | 8 | 3.1 | −0.1 | 0.7 | 15 | A | B | B |
| Ex. 24 | 24 | 8 | 3.1 | −0.1 | 0.7 | 31 | A | B | A |
| Ex. 25 | 25 | 8 | 3.1 | −0.1 | 0.7 | 45 | B | B | A |
| Ex. 26 | 26 | 9 | 5.2 | −0.1 | 0.7 | 18 | A | A | B |
| Ex. 27 | 27 | 9 | 5.2 | −0.1 | 0.7 | 27 | A | A | A |
| Ex. 28 | 28 | 9 | 5.2 | −0.1 | 0.7 | 48 | B | A | A |
| Ex. 29 | 29 | 10 | 3.2 | 0.1 | 0.6 | 36 | A | B | A |
| Ex. 30 | 30 | 11 | 3.1 | 0.0 | 0.6 | 43 | A | B | A |
| Ex. 31 | 31 | 12 | 5.3 | 0.1 | 0.6 | 29 | A | A | A |
| Ex. 32 | 32 | 13 | 5.1 | 0.0 | 0.6 | 49 | A | A | A |
| Ex. 33 | 33 | 14 | 5.1 | 0.2 | 0.5 | 21 | A | A | B |
| Ex. 34 | 34 | 15 | 5.1 | 0.2 | 0.5 | 46 | A | A | A |

TABLE 2-continued

| | Recording medium | Substrate | Ra (μm) | Rsk | RSm (mm) | Coating thickness of ink receiving layer (μm) | Cracks | Peeling off | Ink absorbency |
|---|---|---|---|---|---|---|---|---|---|
| Comp. Ex. 1 | 35 | 16 | 2.8 | −0.1 | 0.7 | 33 | A | C | A |
| Comp. Ex. 2 | 36 | 9 | 5.2 | −0.1 | 0.7 | 52 | C | A | A |
| Comp. Ex. 3 | 37 | 17 | 5.1 | 0.3 | 0.7 | 26 | C | A | A |

As shown in Table 2, the recording media of Examples 1 to 34 were good in all of Cracks of the ink receiving layer, Peeling off upon folding and Ink absorbency.

On the other hand, in the recording medium of Comparative Example 1, the Ra of the surface of the substrate on the side of the ink receiving layer was 2.8 μm, and peeling off of the ink receiving layer was clearly observed upon folding. In the recording medium of Comparative Example 2, the coating thickness of the ink receiving layer was as thick as 52 μm, and cracks having a length of 1.0 mm or more were observed on the surface of the ink receiving layer. In the recording medium of Comparative Example 3, the Rsk of the surface of the substrate on the side of the ink receiving layer was 0.3, and cracks having a length of 1.0 mm or more were observed on the surface of the ink receiving layer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-129273, filed Jun. 4, 2010, which is hereby incorporated by reference herein in its entirety.

What is claimed is:

1. A recording medium comprising:

a substrate; and an ink receiving layer provided on the substrate, wherein the substrate is a resin-coated substrate obtained by coating a base material with a resin, wherein an arithmetic average roughness Ra of a surface of the substrate on the side of the ink receiving layer as prescribed by JIS B 0601:2001 is 3.0 μm or more, wherein a skewness Rsk of a roughness curve of the surface of the substrate as prescribed by JIS B 0601:2001 is 0.2 or less, and wherein a coating thickness of the ink receiving layer is 50 μm or less.

2. The recording medium according to claim 1, wherein the arithmetic average roughness Ra of the surface of the substrate on the side of the ink receiving layer as prescribed by JIS B 0601:2001 is 4.0 μm or more.

3. The recording medium according to claim 1, wherein the skewness Rsk of the roughness curve of the surface of the substrate on the side of the ink receiving layer as prescribed by JIS B 0601:2001 is 0.0 or less.

4. The recording medium according to claim 1, wherein the coating thickness of the ink receiving layer is 25 μm or more.

5. The recording medium according to claim 1, wherein an average length RSm of a roughness curve element of the surface of the substrate on the side of the ink receiving layer as prescribed by JIS B 0601:2001 is 0.6 mm or less.

6. The recording medium according to claim 1, wherein the arithmetic average roughness Ra of the surface of the substrate on the side of the ink receiving layer as prescribed by JIS B 0601:2001 is 7.0 μm or less.

7. The recording medium according to claim 3, wherein Rsk is greater than or equal to −1.5.

8. The recording medium according to claim 1, wherein the coating thickness of the ink receiving layer is 40 μm or more.

* * * * *